United States Patent [19]

Turner

[11] 4,388,678

[45] Jun. 14, 1983

[54] READING AND VIEWING LAMP

[76] Inventor: Wheeler M. Turner, 4689 Puente Plz., Santa Barbara, Calif. 93110

[21] Appl. No.: 196,391

[22] Filed: Oct. 14, 1980

[51] Int. Cl.[3] ..... F21Y 9/00

[52] U.S. Cl. ..... 362/293; 362/33; 362/347; 362/98; 362/318; 362/127; 362/322; 362/294; 362/296; 362/310; 362/345

[58] Field of Search ..... 362/33, 96, 97, 101, 362/127, 128, 145, 153, 293, 294, 296, 297, 310, 318, 345, 32, 356, 98, 99, 347, 322

[56] References Cited

U.S. PATENT DOCUMENTS

| | | | |
|---|---|---|---|
| 2,744,192 | 5/1956 | Rosenthal | 362/410 X |
| 3,087,381 | 4/1963 | Moffatt | 362/345 X |
| 3,586,851 | 6/1971 | Rudolph | 362/293 |
| 3,984,673 | 10/1976 | Gray | 362/293 |
| 4,232,362 | 11/1980 | Williams et al. | 362/801 X |

*Primary Examiner*—Peter A. Nelson

[57] ABSTRACT

This invention provides an improved reading or viewing lamp that achieves extraordinary visual acuity when properly used. The lamp employs a quartz-halogen bulb together with a parabolic lens to provide a collimated beam. A light filter removes heat radiation and ultra violet radiation from the beam. A convex mirror reflects the filtered light beam to the reading or viewing area where because of the point source characteristic of the bulb and the remaining optics, the rays are substantially non-crossing and transversely coherent in the reading or viewing area. In one embodiment, the collimated beam is directed vertically and tubular light shield surrounding the collimated light beam and a cylindrical shield around the convex mirror reduces transverse radiation of light to other parts of the room. The shield around the collimated beam also provides a chimney effect which disperses the heat throughout the room to points remote from the reader.

17 Claims, 13 Drawing Figures

READING AND VIEWING LAMP

INTRODUCTION

This invention relates to lamps and more particularly to incandescent lamps for illuminating a viewing, working, or reading area. While the invention has many applications, it will be described primarily with particular reference to reading lamps.

PRIOR ART

No prior art search has been made.

ONE OF THE PROBLEMS

The main problem with which this invention is concerned involves the fact that as a person grows older his vision deteriorates making it difficult for him to read. In most cases, he becomes farsighted and seeks aid from prescription glasses. Because of age-related maladies, such as cataracts, he also finds it desirable to increase the illumination in the reading area. But this adds a special difficulty. As the intensity of the light source is increased, the amount of heat generated also increases, increasing the discomfort of the reader. This is particularly deleterious where incandescent lamps are employed, for reasons which will become apparent hereinafter.

GENERAL DESCRIPTION OF INVENTION

This invention makes use of an incandescent lamp of the point-source type in its preferred embodiment and optical filters are employed for attenuating the heat radiation and also the ultra-violet radiation that may be present in the light. In addition, light is transmitted as a collimated beam through the filters and this beam is reflected by a convex mirror to the viewing area as a diverging beam of non-crossing rays.

According to the present invention, an improved reading or viewing light is provided that employs a very high intensity light source of small size and power such as a quartz-halogen bulb designed for automotive use, means for capturing most of the radiation from the light source and focusing it into a narrow collimated beam, means located in the beam for filtering out both ultra-violet radiation and heat radiation, and an adjustable convex mirror for intercepting the collimated beam and deflecting the beam downwardly and laterally to the reading area.

The beam in the reading area is characterized by rays which diverge outwardly from a virtual source behind the mirror and is therefore characterized by rays which are substantially non-crossing in the reading area. The beam is also characterized by being coherent across its cross-section. This coherence is to be distinguished from that which exists along the direction of light travel characteristic of laser light.

By employing a quartz-halogen bulb the filament may be operated at a higher temperature than otherwise thus achieving a color temperature of 2360° K. This type of lamp has the advantage of producing such high color temperature radiation by employing a quartz bulb. But glass is employed in the path of the beam for filtering out the ultra-violet radiation.

The employment of a diverging non-crossing beam has the advantage of generating sharp shadows even for very small objects or thin coatings on surfaces, thus rendering the lamp suitable for use for fine work on small electronic components or jewelry.

Such a lamp is very effective for reading in a room where the ambient or general illumination in the reading area is less than about 20% of the illumination from the lamp in the reading area.

Special means are provided to prevent radiation from disturbing other people in the room with the reader.

In contrast with ordinary arrangements for illuminating a reading or viewing area in which general illumination is provided that produces soft shadows, applicant's lamp generates sharp shadows. This fact alone accounts for an increase in visual acuity of objects, and even reading materials, being examined by the user.

In a practical application of the invention, a 55-watt bulb is employed to produce illumination in the reading area which is 4 to 10 times the intensity that would ordinarily be encountered by illumination from other sources such as flourescent light or from an ordinary reading light of 150 watts.

ADVANTAGES AND OBJECTS

With this invention the ability to read is enhanced to such an extent that a person using the lamp may experience comfortable reading without glasses if he needs little correction, comfortable reading with printed material in various positions for one requiring more correction, and the ability to read with glasses for one who heretofore was not able to read at all. The visual acuity of workers concerned with assembly of small parts is also greatly enhanced. With this invention the useful work life of a person performing fine assembly work may be extended to the benefit of worker and employer alike.

One of the objects of the invention is to provide an improved lamp for illuminating the material in a reading or other viewing or working area.

Another object of the invention is to provide for greater illumination with substantially less heat being radiated onto the user or the subject matter.

Another object of the invention is to provide an improved lamp for improving the examination of texture of objects.

Still another object of the invention is to provide an improved radiation field for lighting paintings, flower arrangements, and other beautiful objects.

Still another object of the invention is to reduce the perceived glare by reflected light emanating from the subject matter being viewed.

Another object of the invention is to provide for locating the actual light source remotely from the apparent source.

Another object of the invention is to provide a lamp of high illumination from a source of low power.

And another object of the invention is to provide high illumination in the reading or viewing area while radiating very little illumination that would be disturbing to others in the same room.

And still another object of the invention is to facilitate reading for people with deteriorating or poor vision.

The foregoing objects and advantages and features of the invention will be understood more readily from the following description of the invention taken in conjunction with the accompanying drawings, wherein:

THE DRAWINGS

DETAILED DESCRIPTION

Figure 1:
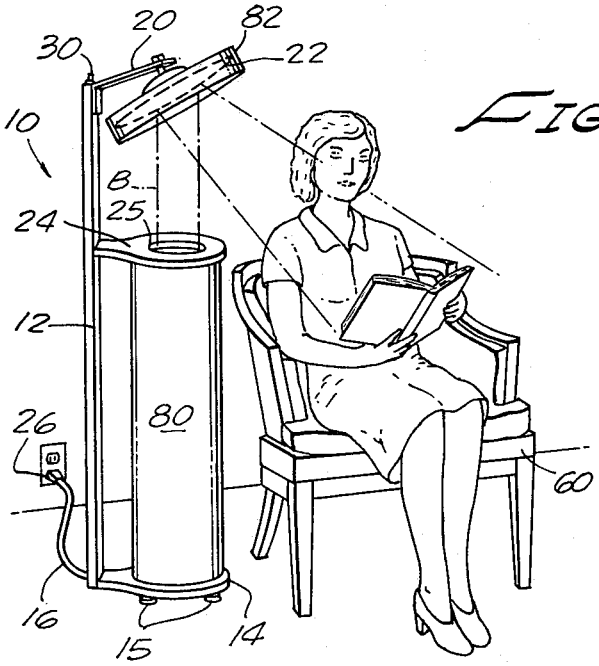
FIG. 1 is a perspective view of the invention in use for reading.
Figure 2:
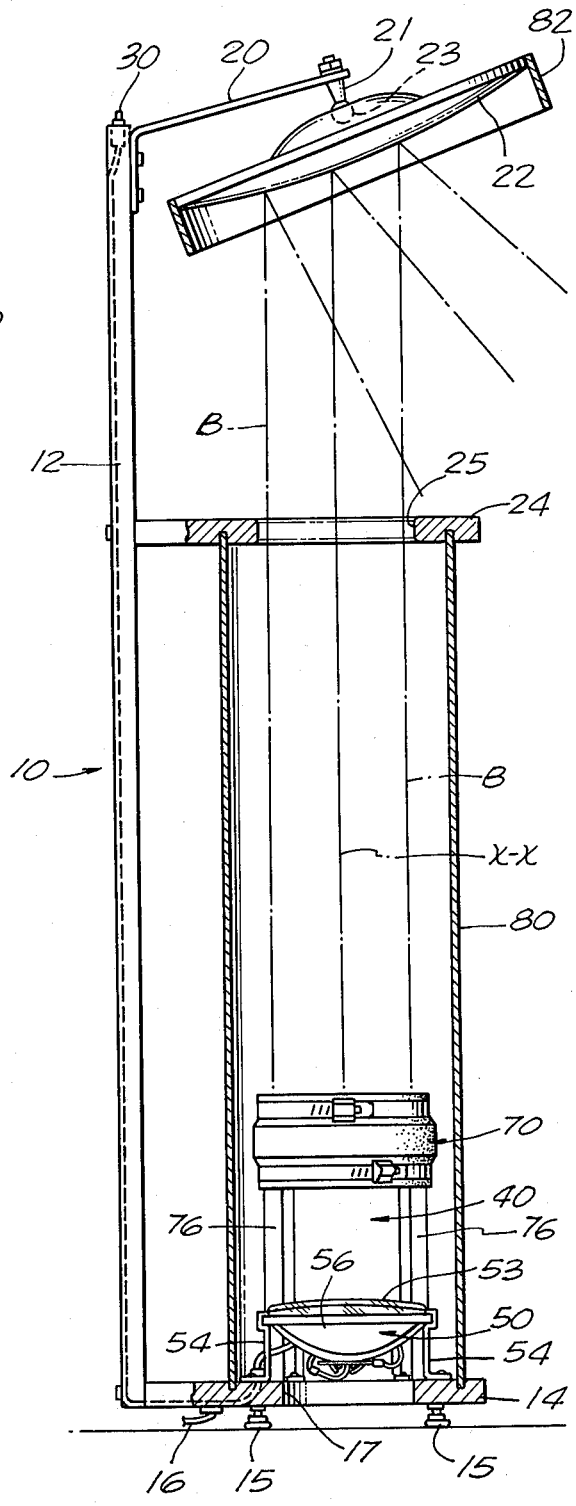
FIG. 2 is an elevational view partly in section of the reading lamp.
Figure 3:
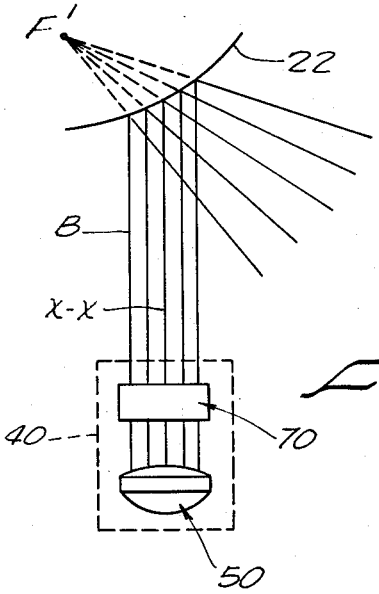
FIG. 3 is a diagram employed for explaining the invention.

In the drawings, and particularly in FIGS. 1, 2, and 3, there is illustrated a reading lamp that embodies the present invention. The lamp 10 comprises an upright member or standard 12, a base member 14 having four feet 15 which support the lamp on the floor, an upper arm 20 for supporting a spherical convex mirror 22, and an intermediate support member 24. The base member 14, the intermediate member 24, and the upper support member 20 extend laterally from one side of the upright member 12 to provide vertical alignment of a light source 40 with the convex mirror 22. An electric cord 24 and a wall-plug 26 connect the lamp to the house mains that provide the power of standard voltage such as 110 volts AC. An electric push-button switch 30 at the top of the upright member serves to switch the light on or off as needed.

The light source 40 at the bottom projects a collimated beam upwardly to the center of the convex mirror 22 which then reflects the light as a diverging beam to the reading area in which, in this case, a book is held for reading by a lady seated on a chair 60 beside the lamp.

The base member 14 has a central aperture 17 to provide access to the light source 40 from the lower side thereof to replace or adjust the light. The intermediate member 24 is provided with a central aperture 25 through which the collimated beam is projected toward the convex mirror 22.

The support arm 20 is in the form of a bracket attached to the upper end of the upright member 12 and is provided with a ball joint 21 which is clasped by a balljoint socket 23 to which the convex mirror 22 is firmly but adjustably attached. The vertically directed collimated beam B is reflected by the convex mirror 22 downwardly and laterally toward the viewing area.

The apertures 17 and 25 of the two members 14 and 24 respectively are coaxial with each other and with an axis X—X that extends through the ball joint 21.

A liquid filter 70 is mounted transversely of the collimated beam between the two members 14 and 24 to intercept the beam and to filter out ultra-violet and infra-red rays.

With this arrangement maximum visual acuity is achieved when the light illuminating the book is the principal light reaching it. High visual acuity is achieved particularly when the intensity of the ambient light is less than about twenty (20) percent of the illumination from the viewing or reading lamp 10 of this invention. And reading is accomplished with maximum comfort because the ultra-violet and heat rays that would otherwise reach the reading or viewing area are filtered out of the radiation that is directed toward the reader and the book. The reasons for the improvement in visual acuity resulting from this invention are explained more fully hereinafter.

An opaque tube 80 encloses the collimated beam in the area between the base and intermediate members 14 and 24, thus practically eliminating the radiating of high intensity light toward other people in the room. Likewise a short tubular shield 82 encircles and is supported by the convex mirror 22 to minimize the diffusion of light from irregularities in the mirror 22 and dust particles on its surface in a horizontal direction to others who may be in the room.

The light source 40 consists primarily of two components, the electric light 50 and the light filter 70. The light 50, as shown more particularly in FIGS. 5, 6, 7, and 8 is a low-voltage high-current halogen-quartz sealed lamp 54 of the type employed in automobile headlights, such as type JA12V55W type H-3 manufactured and sold by USHIO Electric, Inc., Tokyo 100, Japan. The sealed lamp 54 is supplied with electric power from a stepdown transformer 31. The envelope 52 of the light 50 is composed of quartz and a small amount of a halogen, such as iodine, is sealed within the envelope. Such a sealed lamp is characterized by providing white light and by having long life.

Figure 4:
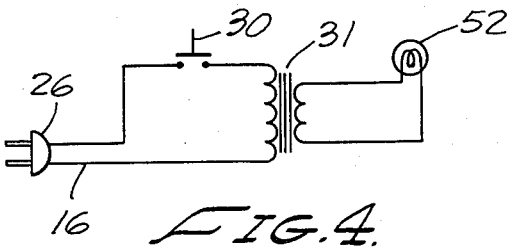
FIG. 4 is a wiring diagram of the electrical circuitry.
Figure 5:
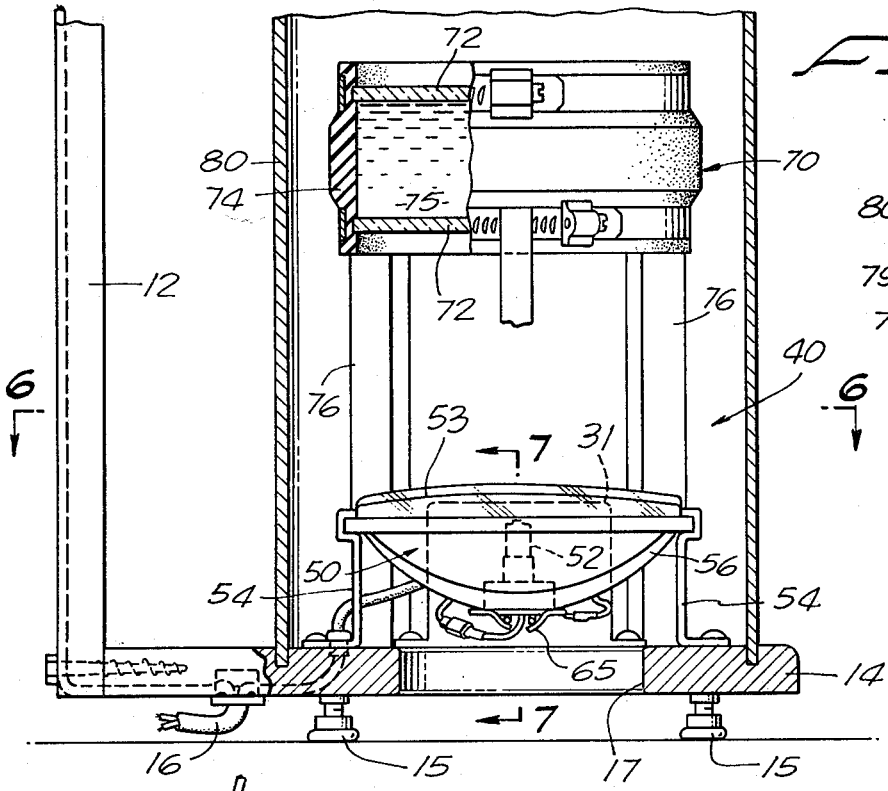
FIG. 5 is an enlarged detailed side elevational view partly in section of a light source employed in the invention.
Figure 9:
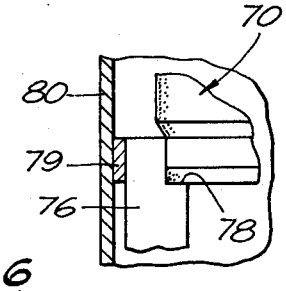
FIG. 9 is a detail of the support structure for the liquid filter.
Figure 8:
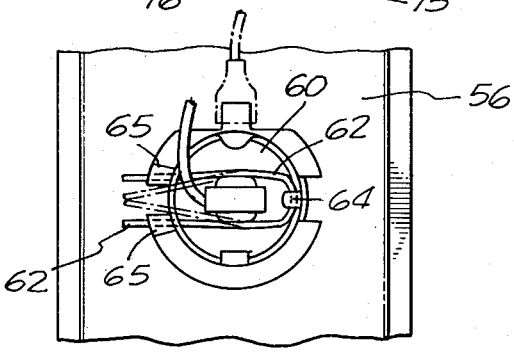
FIG. 8 is a bottom view taken on the plane 8—8 of FIG. 7.
Figure 7:
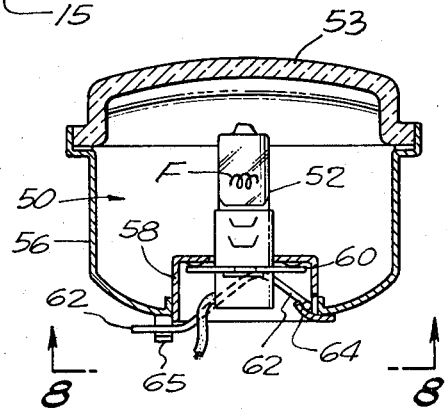
FIG. 7 is a cross-sectional view taken on the plane 7—7 of FIG. 5.
Figure 6:
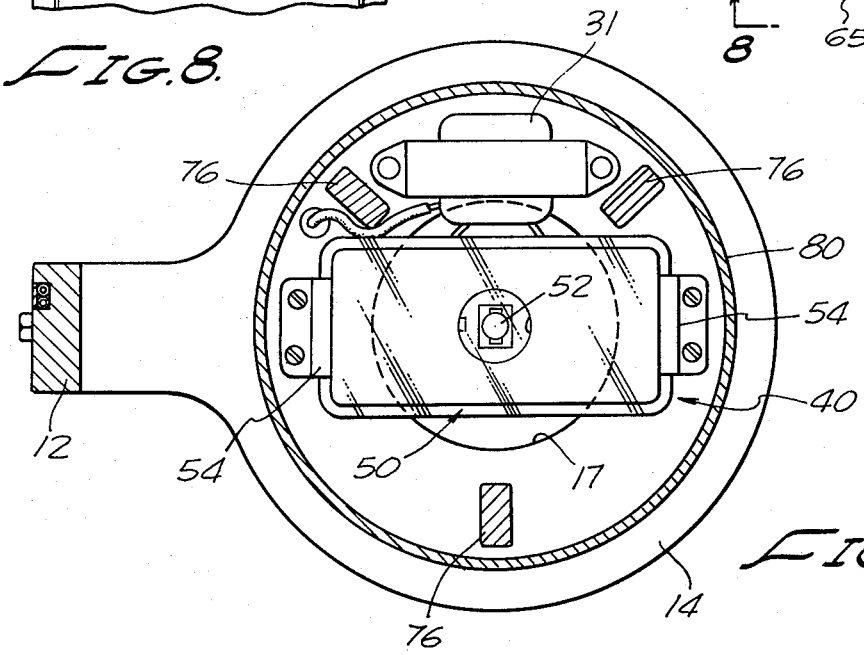
FIG. 6 is a plan view taken on the plane 6—6 of FIG. 5.

The sealed lamp has a short coiled filament F of about 5 mm in length and a diameter of about 1 mm so that it acts as a point source. The terminals of the lamp are suitably connected to the secondary winding of the transformer 31 (see FIGS. 4 and 6). The sealed lamp is mounted in a conventional manner with its filament at the focal point of a parabolic reflector 56 which thereby causes the light to be reflected upwardly as a collimated beam of white light.

The particular reflector 56 employed here is of a somewhat rectangular cross-section in a horizontal plane and it is supported between two vertically extending brackets 54 that are attached to the base member 14 on opposite sides of the access aperture 15. The reflector 56 is composed of pressed metal having an internal surface with a bright mirror finish. A small cup 58 projecting inwardly of its bottom and secured thereof serves for mounting the sealed lamp 54 with its filament F at the focal point. The sealed lamp itself is suitably secured to a mounting flange 60 which is removably held in place by means of a wire spring 62 engaging clips 64, 65 secured to the bottom of the reflector. The reflector 52 is provided with a mounting ring which is embraced by upper fingers on the brackets 54 holding the light accurately in place on the vertical optical axis X—X of the lamp. A cover or lens 53 composed of glass and of uniform thickness protects the sealed lamp. The reflector 54 is actually of symmetrical paraboloid configuration, truncated on its sides by flat walls. The axis of the paraboloid is vertical, coinciding with the vertical axis X—X of the reading lamp.

The axis of the coil of the filament F is substantially normal to the flat sides of the reflector. The filament is located at the focal point of the reflector which is about 1¼" from the base or origin of the reflector and about half that distance from its upper edge. The window formed by the lens is about 5" by 2½". With this arrangement almost half of the radiation emitted from the filament forms the collimated beam.

The light filter 70 is in the form of a liquid cell comprising a pair of glass plates 72 mounted in spaced apart relation by means of a flexible cylindrical wall member 74 with a body of fluid 60 filling the interior space. Sterile water is a suitable liquid for filtering out infrared radiation. Preferably it is sterilized with a fungicide. And the end walls 72 may be glass, such as dense flint glass, for filtering out ultraviolet radiation. The cylindrical wall member 74 is held in place by means of two clamping bands that encircle it at the upper and lower ends directly around the edges of the glass plates 72. The member 74 is flexible to accommodate expansion and contraction of the liquid due to heating and cooling. The liquid cell is supported on a plurality of upstanding members 76 secured to the base plate 14. The upper ends of the upstanding members 76 are provided with steps 78 for supporting the filter 70 and outwardly projecting spacer blocks 78 for slidably engaging the inne wall of the cylindrical tube shield 80.

The action of the glass plates in filtering out ultra-violet radiation may be supplemented by employing a rear-surface glass mirror as the convex reflector 20. In this arrangement the double traversal of the light through the glass increases the filtering action.

The support structure and the shields 80 and 82, as well as other external parts of the lamp, are coated with a decorative material which may actually be in the form of black paint that provides a matte finish. The heat absorbed by the light filter 70 is dissipated into the surrounding room partly by convection and partly by re-radiation from the filter 70 and from the shield 80. Such dissipation of heat avoids concentration of the heat on the reader or the subject matter being viewed in the reading area.

The arrangement of the aperture 17, the support arms 76, and the light shield 80 provide passages for the free flow of air upwardly past the light source 40 and through the shield 80 and its exit aperture 25 thus producing a chimney effect. This effect serves to cool the components of the light source 40 including the light 50 and the filter 70 and to disperse the heat throughout the room to points remote from the reader.

Figure 10:
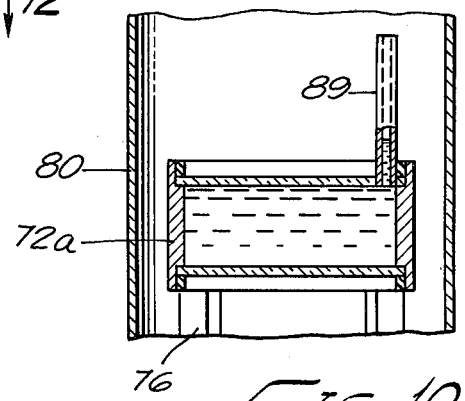
FIG. 10 is a cross-sectional view of an alternative form of liquid filter.

In alternative form of filter illustrated in FIG. 10, the cylindrical member **72*a* may be stiff or rigid; and expansion and contraction of water due to temperature changes may be taken up by means of a vertically extending tube 89**.

The geometry of the travel of the light rays from the point source to the field of view is brought out in FIG. 3. As there indicated, the rays of light projected vertically along the optic axis X—X of the reading lamp. As this beam travels upwardly, it passes through the filter 70 and is incident upon the spherical mirror 22 and is reflected by it downwardly as a diverging beam that appears to come from a virtual point source F', illuminating the viewing area. The beam striking the area is coherent over its cross section and at each point in the field of illumination in the viewing area, the light appears to be coming from one direction only. The actual direction of reflection of the beam by the convex mirror is rendered adjustable by virtue of the ball joint 21.

For greater flexibility when using a lamp of rectangular cross section, the lamp and filter may be rotatably mounted on the base 14. This may be accomplished, for example, by mounting the light source 50 on a circular track so that it may be rotated about its vertical axis X—X. With such an arrangement controlled by means of a crank or knob that projects through the cylinder 80, the collimated beam may be oriented in any way desired relative to the object or other material being viewed.

The unidirectional, non-crossing, property of the beam in the reading area is established in part from the fact that the filament F acts as a point source, the maximum dimension of the filament being very small compared with the width of the collimated beam formed by it and the reflector. Furthermore, the beam is of uniform intensity, being substantially free of flicker because of the fact that it is energized by low-voltage power and the filament itself is thick.

For reasons which are not fully understood, the visual acuity in the viewing area is increased over what it would ordinarily be if the same amount of light were flooding the area but from different directions. The improvement in visual acuity is attributed in part to the fact that the illumination is intense in the reading area thereby causing the irises of the viewer's eyes to be reduced in diameter. At the same time the comfort of the reader is increased by virtue of filtering out of the ultra-violet and heat rays. High visual acuity is also attributed to this invention partly because the lamp generates sharp shadows at the edges of objects, even very thin objects.

The invention is particularly suitable for use by older people. Normally, as one grows older, his eyes begin to fail in two respects. First of all, he tends to become far-sighted requiring corrective lenses. And secondly, maladies such as cataracts often develop that affect the focal properties of the eye or reduce the amount of light reaching the retina. Both conditions require increasing light intensity to achieve comfort in reading and other eye usage for close objects.

Figure 13:
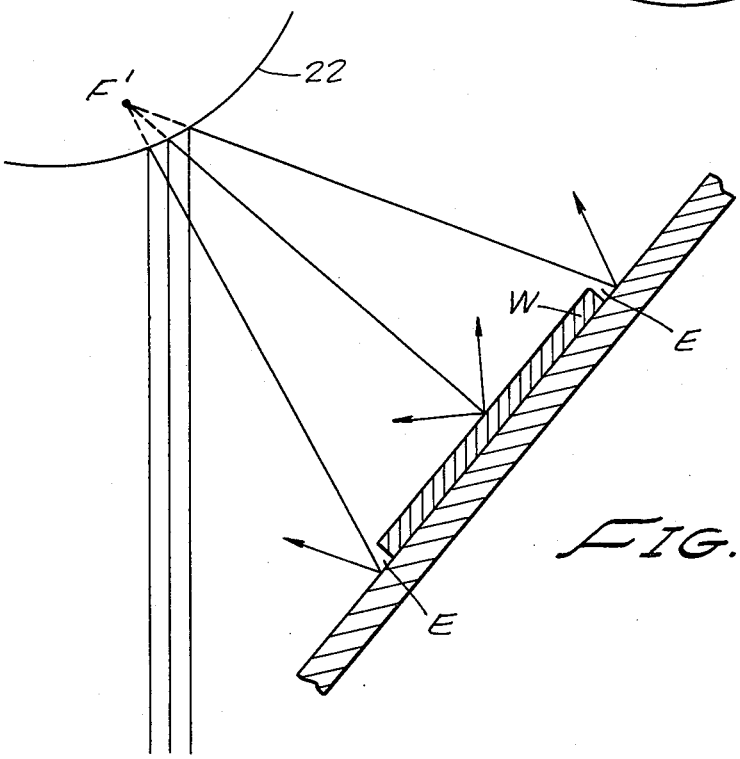
FIG. 13 is a schematic view employed in an explanation of the invention.

The lamp of this invention is also especially useful for workers, both old and young alike, who work on miniature items such as integrated circuits. The viewing of such objects is aided by the sharp, though small, shadows formed at the edges of various surfaces. That this is so is illustrated by way of example in FIG. 13 which shows in a highly exaggerated manner divergent rays from the virtual point source F' as they travel toward the work piece W casting a shadow at the edges E, E. In this connection it will be readily apparent that if the radiation were traveling to the work piece W from all directions as would be the case if an overhead flourescent light were used for illuminating the viewing or working area, light would strike the edges E, E from various directionsl thereby producing only soft shadows at the edges.

In a practical embodiment of the invention, the upstanding member 12 was forty-four inches long. And the axis X—X was displaced about 12 inches from the member 12. And the main light shield 80 had a diameter of 8 inches and a height of 40 inches. And the opening 25 had a diameter of 5 inches.

The spherical mirror 22 had a radius to the center of its sphere of 60 inches and hence a focal length of 30 inches and a sector diameter of about 13 inches, and the auxiliary light shield 82 on the edge of the mirror had a height of 2 inches.

The liquid filter 70 had a thickness of 3 inches with the glass plates each having a thickness of ½ inch.

From tests it has been determined that visual acuity is improved significantly if the illumination from the lamp of this invention exceeds the other illumination on an object being viewed, by a factor of at least 4 to 1. Furthermore, by concentrating the light by means of the collimating system, less electric power is required for the same amount of illumination.

While the invention has been described with reference to the use of a vertical collimated beam generated in a system which rests on the floor, it will be understood that the invention may be embodied in other forms such as one in which the support for the optical system rests on the surface of a desk. It may also be employed in one in which the optical axis is about horizontal, such as is an arrangement in which the light source and collimator and filter are at the edge of a room and transmit the collimated beam to a convex mirror mounted near the viewing area.

ALTERNATIVE EMBODIMENTS

Figure 11:
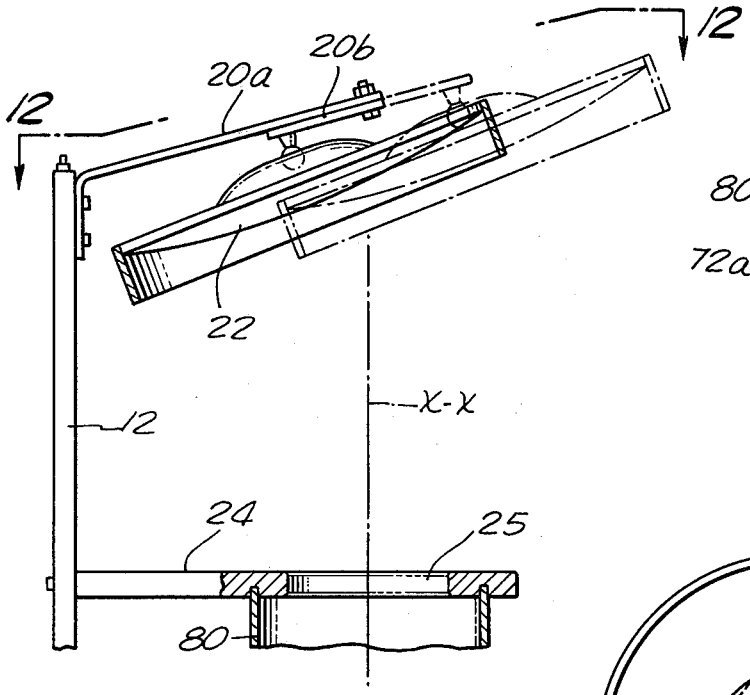
FIG. 11 is a fragmentary side view of an alternative arrangement for mounting the convex mirror.
Figure 12:
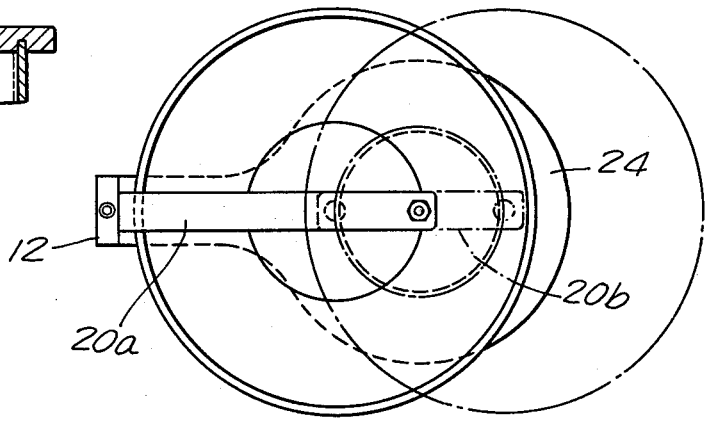
FIG. 12 is a plan view of the arrangement illustrated in FIG. 11.

In an alternative embodiment of the invention illustrated in FIGS. 11 and 12, the mirror is mounted at the end of an articulated arm 20 consisting of two pivotally connected parts. One long part or arm 20*a* has its outer extremity on the axis of the collimated beam and the short part or arm 20*b* is pivotally connected at that extremity, so that it may be rotated in a horizontal plane about the optical axis X—X. The short arm 20*b* has a radius about equal to that of tube 80. This arrangement provides greater flexibility in locating the lamp relative to the viewing area. Thus, the articulated support arm 20 may be manipulated to direct the light downwardly more than otherwise and thus increase the effectiveness of the shield 22 in obscuring the horizontal transmission of light from the convex mirror to others in the room.

The invention has been described above with reference to the use of a spherical convex mirror thereby producing a beam as if it had its origin in a virtual point source F'. But the invention may be employed with other types of convex mirrors, even a circular cylindrical mirror in which the virtual source is no longer a point, but is a line. In either case, the rays that illuminate the viewing area are coherent and are unidirectional at each point in the viewing area instead of being heterodirectional as they would be if the light had its origin in an elongated fluorescent ceiling lamp. In any event, the rays are substantially non-crossing in the viewing area.

OTHER USES

In the foregoing description of the invention, emphasis has been on the use of the invention for reading and for fine work on small parts. The invention may also be used in many other ways.

By way of example, the invention may be employed in surgery where high resolving power and hence high visual acuity is often essential. The invention may also be employed in connection with artistic displays, such as bouquets. The invention may also be employed to examine decorative surfaces.

The invention is also applicable to portrait photography and television where it is common to employ light of high intensity, thereby overheating the subject.

With the lamp of this invention, improved rendition of color paintings may be achieved by directing the diverging beam of white light onto the painting with the invisible ultra-violet and heat components of the radiation substantially filtered out. Such improved rendition arises from the fact that the spectrum from the source closely matches that of mean noon sunlight (see page 164, "Encylopedia of Science and Technology", McGraw-Hill (1960)). Paintings viewed this way evoke favorable responses from viewers and the freedom of the light of ultra-violet and heat rays helps preserve the painting.

The invention may be used in many other ways than those specifically described herein and may be embodied in many other forms within the scope of the appended claims.

I claim:

1. In apparatus for directly illuminating an area with a diverging light beam wherein written material or other objects are adapted to be directly viewed in the directly illuminated area, the combination of:

a convex mirror mounted to receive a collimated beam of light and to reflect the collimated beam of light into a diverging beam of light which is directed towards that area; and means including a source of light for directing a collimated beam of light toward said convex mirror for reflection toward that area, whereby the area is illuminated primarily by light of substantially non-crossing, diverging and unidirectional quality throughout said area.

2. In apparatus as in claim 1, the combination therewith of:

filtering means in the path of said beam between said light source and said convex mirror for filtering out heat rays from the beam.

3. In apparatus as defined in claim 1, the combination therewith of:

filtering means in the path of said beam between the light source and said convex mirror for filtering out ultra-violet rays from said beam.

4. Apparatus as defined in claim 1, the combination therewith of:

filtering means in the path of said beam between said light source and said convex mirror for filtering out heat rays and ultra-violet rays from said beam.

5. The apparatus as in claim 2, the combination therewith of:

a parabolic mirror for reflecting light from a substantially point source and for reflecting said light as a collimated beam toward said convex mirror.

6. In apparatus as in claim 5, the combination therewith of:

a liquid cell mounted transversely of said collimated beam, said water cell comprising a pair of parallel flat plates that absorb ultra-violet radiation, said liquid cell being filled with heat-ray absorbing liquid, whereby the light beam remains collimated after passage through said cell.

7. In apparatus as defined in claim 1, the combination therewith of:

a light shield surrounding said mirror for acting as a barrier to the transmission of light from said mirror in a horizontal direction.

8. In apparatus as defined in claim 5, the combination therewith of:

an open ended opaque tube surrounding said collimated beam for preventing viewing of the light source and said parabolic mirror from the side of said beam.

9. In apparatus as defined in claim 6, the combination therewith of:

an open ended opaque tube surrounding said collimated beam and said liquid filter for preventing viewing of the light source and said parabolic mirror and said liquid filter from the side of said beam.

10. In apparatus as defined in claim 1, the combination therewith of:

means adjustably supporting said convex mirror for altering the direction of reflection of said beam relative to the direction of incidence of the beam on said convex mirror whereby the area illuminated by said reflected beam may be altered.

11. In apparatus for directly illuminating an area with a diverging light beam wherein reading material or other objects may be directly examined, the combination of:

a support structure having a base member at the lower end thereof and a support member at the upper end thereof;

means including a substantially point source of light and a parabolic mirror firmly mounted on a said base member for projecting a collimated beam of light upwardly toward said upper member; and a convex mirror mounted on said support member for intercepting said collimated beam and for reflecting the beam as a diverging beam transversely and downwardly toward said area.

12. An apparatus as defined in claim 11, the combination therewith of:

filtering means supported in the path of said beam between said point source and said convex mirror for filtering out heat rays and ultra-violet rays from the beam.

13. An apparatus as defined in claim 11 in which:

said upper support member comprises two articulated arms, one of said arms being secured to said support structure and having an end remote from the support structure terminating near the center of said collimated beam and the other of said arms being pivotally connected to said remote end and means at the free end of said other arm adjustably supporting said convex mirror at the other end thereof whereby the direction of reflection toward said area is adjustable.

14. In apparatus as in claim 11, the combination therewith of:

a liquid cell mounted transversely of said collimated beam, said liquid cell comprising a pair of parallel flat plates that absorb ultra-violet radiation, said liquid cell being filled with heat-ray absorbing liquid, whereby the light beam remains collimated after passage through said cell.

15. In apparatus as defined in claim 14, the combination therewith of:

a light shield attached to and surrounding said convex mirror for acting as a barrier to the transmission of light from said mirror in a horizontal direction; and an open ended opaque tube supported from said base member surrounding said collimated beam for preventing viewing of the light source and said parabolic mirror from the side of said beam.

16. In apparatus as in claim 11, the combination therewith of:

a liquid cell mounted transversely of said collimated beam, said liquid cell comprising a pair of parallel flat plates that absorb ultra-violet radiation, said liquid cell being filled with heat-ray absorbing liquid, whereby the light beam remains collimated after passage through said cell, an open ended opaque tube supported from said base member surrounding said collimated beam and said liquid cell for preventing viewing of the light source and said parabolic mirror and said liquid cell from the side of said beam, said upper support mirror comprising two articulated arms, one of said arms being secured to said support structure and having an end remote therefrom aligned with the central axis of said beam, and the other of said arms being pivotally connected to said remote end and adjustably supporting said convex mirror at the other end thereof whereby the direction of reflection toward said area is adjustable.

17. An apparatus as defined in claim 11 or in claim 16 wherein said convex mirror is a rear surface mirror.

* * * * *